United States Patent [19]

Albert

[11] 3,972,443

[45] Aug. 3, 1976

[54] DRINKING RECEPTACLE

[75] Inventor: Kenneth J. Albert, Hollywood, Calif.

[73] Assignee: Thermo Seal, Los Angeles, Calif.

[22] Filed: Nov. 1, 1974

[21] Appl. No.: 519,862

[52] U.S. Cl. ..... 220/90.4; 220/9 R; 220/378; 222/511; 222/518; 222/542

[51] Int. Cl.[2] ..... A47G 19/22

[58] Field of Search ..... 220/90.4, 17, 9 R, 203, 220/348, 361, 378; 222/566–573, 511, 518, 544, 515, 563, 508, 509, 542, 487, 481.5; 215/315, 356, 329; 251/251

[56] References Cited

UNITED STATES PATENTS

| | | | |
|---|---|---|---|
| 474,172 | 5/1892 | Kaplan | 222/518 |
| 639,881 | 12/1899 | Bailey | 222/518 |
| 963,333 | 7/1910 | Stapleton | 222/511 |
| 1,046,803 | 12/1912 | Kendall et al. | 222/511 |
| 1,543,097 | 6/1925 | Cantor | 222/511 |
| 1,744,358 | 1/1930 | Brown et al. | 222/518 |
| 2,255,879 | 9/1941 | Garvey | 222/518 |
| 2,447,870 | 8/1948 | Polcyn | 220/90.4 |
| 2,521,201 | 9/1950 | Clark et al. | 220/203 |
| 2,667,993 | 2/1954 | Ayres | 222/518 |
| 2,685,978 | 8/1954 | Crockett | 222/511 |
| 2,715,326 | 8/1955 | Gits | 220/9 R |
| 3,156,279 | 11/1964 | Grebowiec et al. | 220/17 |

*Primary Examiner*—George E. Lowrance
*Assistant Examiner*—Allan N. Shoap

[57] ABSTRACT

A drinking receptacle provided with a generally cup-like body and an enclosing cover removably coupled to the top portion and upper open end of the cup-like body; the cover having a drinking or outlet opening near the peripheral rim thereof; and a finger operated valve adapted to open and close said drinking or outlet opening whereby the receptacle may contain hot or cold beverages therein and the valve prevents spillage of said beverages at times when beverages are not being poured or drunk from said drinking or outlet opening. The finger operated valve having an actuator portion reciprocally mounted in the side of the cover or in the side of the drinking receptacle and being coupled directly to and integral with the valve whereby pressure on the actuator by a persons finger may directly open the valve in such a manner as to allow liquid to pass through said drinking or outlet opening. Resilient means tend to hold the valve closed and in accordance with various species of the invention, the finger operated valve may be a poppet type valve openable in a direction against pressure in the receptacle or in the opposite direction whereby pressure may be automatically relieved by force on the poppet against spring pressure which normally tends to hold it closed. The spring force being capable of holding the valve closed to prevent escape of liquid when the contents thereof are under safe pressure conditions.

5 Claims, 6 Drawing Figures

DRINKING RECEPTACLE

BACKGROUND OF THE INVENTION

Various drinking receptacles have been produced in accordance with the teaching of the prior arts so as to provide for the enclosure of contents in a drinking receptacle and whereby the contents may be drunk through a drinking opening when a valve is opened in the cover of the receptacle. Examples of the prior art are found in U.S. Pat. Nos. 2,152,322 and 3,338,467. These patents disclose valves adapted to provide for lip operation thereof or for finger operation thereof. However, these valves of the prior art have various disadvantages, some of which include a tendency of causing vapor pressure to be rapidly expelled and thereby causing a rapid outflow of hot beverages for example, when the valve is operated by the lips and, in addition, such prior art valves are not capable of being controlled accurately by persons fingers preliminary to and concurrently with the usual drinking operations from such closable containers or receptacles.

SUMMARY OF THE INVENTION

The present invention comprises a drinking receptacle having a valve in the cover thereof and the valve is manually operable from a position substantially diametrically opposite from a location in which the drinking opening is disposed near the rim of the container so that the valve in the cover of the container may be concurrently operated during drinking and so that the valve actuator may be relative upward position relative to a downward position of a drinking opening during drinking operations from the receptacle. The drinking receptacle of the invention comprises a novel resiliently mounted poppet valve disposed in a position at a lower side of the top plate portion of the receptacle or in the side wall thereof or in a recessed drinking area of the receptacle cover; the poppet head of the valve being adapted to open and close a drinking or outlet opening near the periphery of the cover of the receptacle and this valve being coupled to a finger operated actuator, and resiliently held normally closed position relative to the drinking or outlet opening. The valve actuator portion of the valve being integral with the valve which is a generally poppet like structure and a resilient spring is disposed for holding the valve normally enclosed position and may be placed in an an alternate position for holding the valve open for washing operations.

Various species of the invention include combined actuator and valve structures mounted in the side wall of the receptacle as well as, in the cover and wherein, a drinking recess is provided near the periphery of the cover in one modification of the invention and is disposed in communication with an openable poppet valve, which opens outwardly into the recess in a direction of pressure thereon from the contents inside the receptacle. The valve thus relieves undue steam pressure in the receptacle in an upright position preliminary to the opening of the valve which thereby prevents the undue and rapid outflow of hot beverages such as coffee, and thereby alleviating the danger to a person drinking who is unaccustomed to the operation of the valve.

Accordingly it is an object of the invention to provide a drinking receptacle having an enclosing cover provided with a drinking or outlet opening therein; and the outlet opening being adapted to be opened or closed by manually operated valve having an actuator disposed substantially diametrically opposite the drinking opening so that the valve actuator may be in an upward postion while the drinking opening is in a downward drinking position to allow a finger of a persons hand conveniently to control the manual opening and closing operation of the valve while holding the receptacle in drinking position.

Another object of the invention is to provide a drinking receptacle having a manually operable valve which is adapted to open and close a drinking or outlet opening near the peripheral rim of said receptacle cover so that the valve may be manually operated by a drinkers finger preliminary to the placing of the receptacle adjacent the drinkers lips so that steam from hot coffee may first be relieved through the drinking or outlet opening thereby alleviating the possibility of steam expulsion of hot coffee or other similar beverages through the opening after the receptacle has been tilted into drinking position.

Another object of the invention is to provide a drinking receptacle having a manually operable drinking valve in the cover thereof whereby hot or cold beverages may be contained in the receptacle and insulated therein so that such beverages may be maintained in either hot or cold condition and so that the person carrying the receptacle may open the drinking valve at will and whereby the contents of the receptacle may be prevented from spilling therefrom during times when beverages are not to be drunk through the drinking opening and when the receptacle is being moved about.

Another object of the invention is to provide a drinking receptacle having a manually operable drinking valve in the cover thereof where by the drinking receptacle may contain hot or cold beverages and may be carried by a person on the move without the danger of spilling the beverages during periods of movements such as may be encountered when a person is carrying the receptacle and is in motion either in self locomotion or in or on a vehicle or the like.

Another object of the invention is to provide a novel drinking receptacle having a finger operated valve which opens into an opening in a recess near the peripheral rim of a cover of the drinking receptacle such that the valve opens with pressure internally of the receptacle. Such pressure being generated at times by steam from hot coffee whereby excessive pressure may be automatically relieved by the valve under its spring loaded closing pressure such as to provide insurance for the relief of undue steam pressure and to thereby insure safety of drinking from the recess adjacent the periphery of the container when the valve is manually opened by a persons finger.

Further objects and advantages of the invention may be apparent from the following specification, appended claims, and accompanying drawings.

DESCRIPTION OF THE PREFERRED EMBODIMENTS

Figure 1:
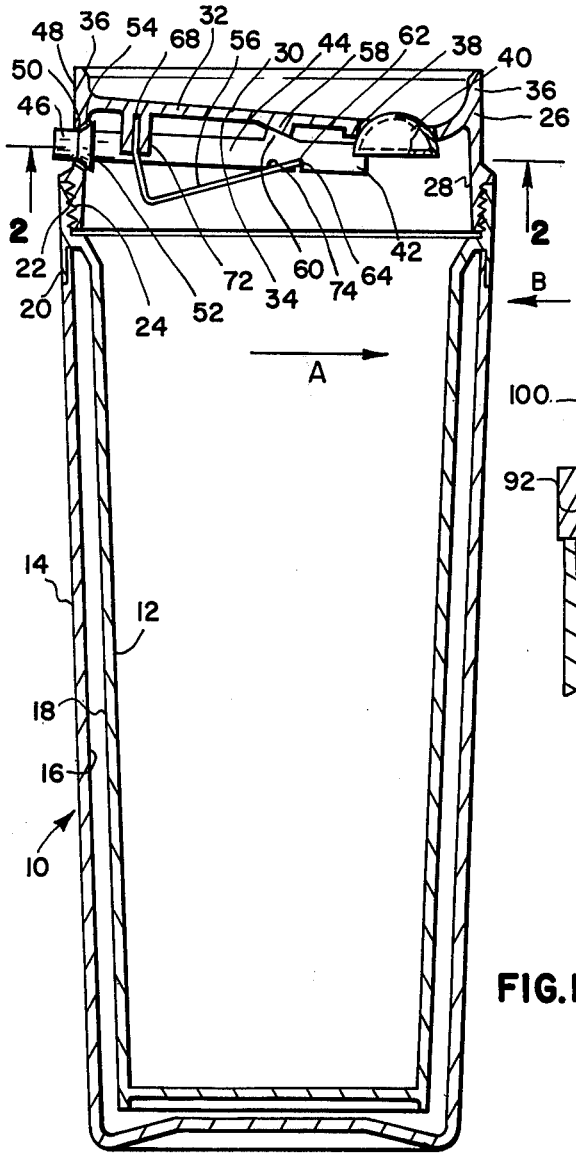
FIG. 1 is a vertical sectional view of a drinking receptacle in accordance with the present invention and showing a finger operated valve structure in connection with the cover of the receptacle.

As shown in FIG. 1, a drinking receptacle 10 is provided with an inner generally cup shaped container portion 12 and an outer shell portion 14. The shell portion 14 having an inner wall 16 spaced from the outer wall 18 of the container portion so as to provide an insulating air space between the container portion and the shell portion. The container portion 12 and the shell portion 14 are press fit together at 20 and the container portion 12 is provided with an internally screw threaded portion 22 adapted to cooperate screw threadably with a screw threaded portion 24 of a receptacle cover 26. This receptacle cover 26 is provided with an angular skirt 28 carrying the threaded portion 24 and its outermost portion and the screw threaded 22 of the container portion 12 is generally an internal screw threaded portion.

The cover 26 is provided with a top plate portion 30 having an upper side 32 and a lower side 34 integral with the top laid portion 32 is a peripheral rim 36 which is elevated somewhat above the upper side 32 of the top plate portion 30.

The top plate portion 30 is provided with a drinking or outlet opening 38 extending through the top plate portion from the upper side 32 to the lower side 34 and this opening 38 is generally circular and is openably enclosed by a poppet valve portion 40 of a valve member 42 which is provided with an integral shank 44 having an integral valve actuator 46 which projects beyond the periphery 48 of the cover 26.

The actuator 46 extends through an opening 50 in the cover in which the actuator is reciprocally mounted. This actuator 46 is integral with the shank 44, the valve 40 and the shank 40 adjacent to the actuator 46 is provided with a poppet valve portion 52 adjacent to which a soft gasket 54 is disposed so the gasket is clamped between the poppet valve 52 and the inner side wall of the cover adjacent and around the opening 50. This clamping force being provided by a spring 56 which tends to hold the poppet 52 adjacent the opening 50 and hold the poppet 40 securely engaged and sealingly enclosing the opening 38. In as much as there may be some discrepancy is spacing between the opening 38 and the side wall of the cover around the opening 50, in correspondence with the relative spacing of the poppet 40 and the poppet 52, the soft gasket 54 compensates for such discrepancy to make an efficient seal around the actuator portion 46 while the poppet 40 is precisely engaged in the opening 38 for closably and openably sealing it.

Integral with the lower side 34 of the top plate 30 is a cam 58 inclined downwardly and toward the opening 38 and integral with the shank 44 of the valve is a mating cam 60 slanting downwardly and toward the opening 38 so that when the actuator 46 is forced in the direction of a Arrow A the cams 58 and 60 tend to cam the shank 44 downwardly and it will be noted that camming action also takes place on the spheroid surface of the poppet valve 40 as it passes laterally relative to the edge of the opening 38. Accordingly, the valve is opened in resistence to the spring 56 which tends to hold the valve upwardly and in closed position as well as to hold it with the actuator member 46 extended in a direction opposite to that of Arrow A in FIG. 1 of the drawings.

Figure 2:
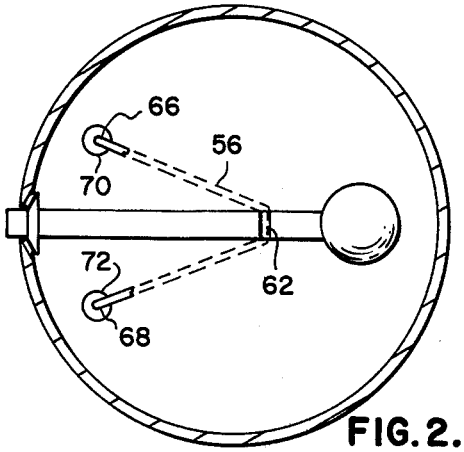
FIG. 2 is a sectional view taken from the line 2—2 of FIG. 1.

The specific construction of the spring 56 is shown best in FIG. 2 of the drawings where an intermediate portion 62 thereof fits into notch 64 in the shank 44 and opposite ends 66 and 68 fit into basses 70 and 72 in the plate portion 30. A second notch 74 in the shank 44 provides a position for the intermediate portion 62 of spring 56 for holding the valves in open position relative to the respective seat openings so that when the receptacle cover is washed, as for example, in the dishwasher, a complete sanitary washing job may be accomplished.

In operation the actuator portion 46 may be pressed inwardly in the direction of Arrow A in FIG. 1 of the drawing, to cam the poppet valve 40 open relative to the opening 38 so that a person may be able to drink from the rim 36 adjacent the opening 38.

The operation of the valve by a persons fingers may be diametrically opposite to the position of the valve 40 and pressure on the actuator 46 overcomes pressure of the spring 56 and allows the valve to be cammed opened by means of the cam portions 58 and 60 herein before described and by camming action of the valve 40 outward and laterally relative to the edge of the drinking or outlet opening 38.

The gasket 54 as herein before described, when the valve is closed, seals around the opening 50 adjacent the side wall of the cover and between the cover and the poppet valve portion 52.

The spring at its intermediate portion 62 may be moved to the notch 74 for holding the valve open wherein it is desired to place the cover in a washing machine for the purpose of washing the cover after a beverage has been contained in the receptacle and poured or drank through the opening 38.

Figure 3:
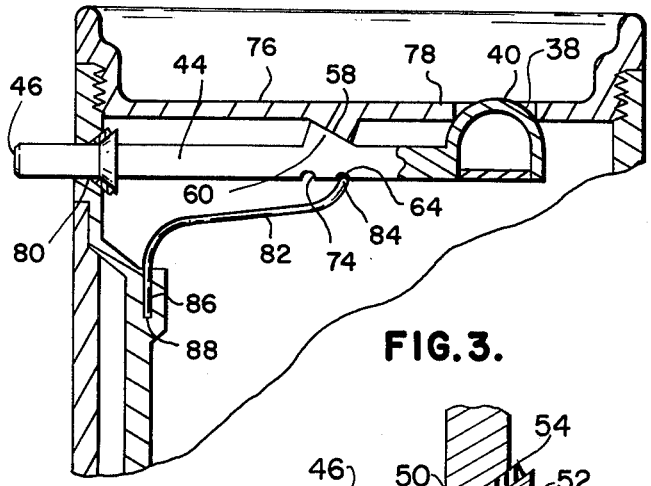
FIG. 3 is a fragmentary sectional view of a modification of the invention similar to that shown in FIG. 1 but showing the finger operated valve projecting through the side of the receptacle body.
Figure 6:
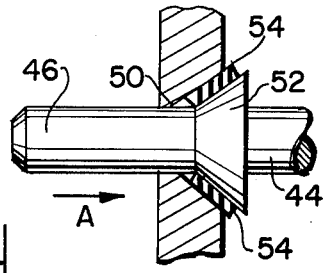
FIG. 6 is an enlarged sectional view of the actuator shown in FIG. 1.

In the modification as shown in FIG. 3, a modified cover 76 is provided with a drink or outlet opening 78 enclosed by the poppet valve 40 and cams 58 and 60 are similar to those herein before described. The valve 40 and shank 44 are similar to that herein before described and the actuator 46 is similar to that herein before described. The difference in the modification is that the acuator shank portion is reciprocally mounted in an opening 80 in the side wall of the receptacle rather than in the side wall of the cover. A spring 82 is provided with an intermediate portion 84 similar to the intermediate portion 62 of the spring herein before described and this spring 82 is provided with end portions 86 fitted in recesses 88 in the side wall of the receptacle container portion and the intermediate portion of 84 of the spring 82 may be placed in either of the notches 64 or 74 as herein before described for the previously described functional arrangements.

Figure 4:
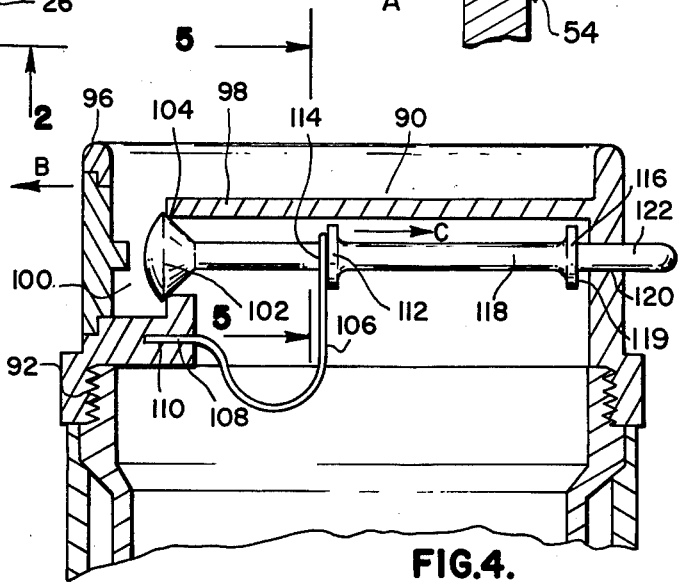
FIG. 4 is another fragmentary sectional view similar to FIG. 3 but showing a further modification of the invention wherein a poppet valve in the cover of the receptacle communicates with a recess adjacent the drinking rim of the receptacle and whereby the valve may be automatically opened by undue steam pressure in the receptacle against compressive force of a spring tending to hold the valve closed.
Figure 5:
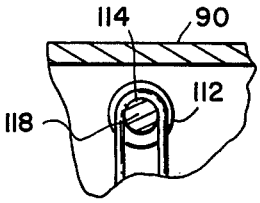
FIG. 5 is a fragmentary sectional view taken from the line 5-5 of FIG. 4.

In the modification as shown in FIG. 4, a cover 90 is provided with a screw threaded connection 92 on the receptacle 94 and the cover 90 is provided with a elevated rim 96 having a top plate 98 recessed there below and a second and further recessed 100 is disposed below the plate 98 adjacent the rim 96 and a poppet valve 102 is mounted on a seat 104 which faces outwardly in the direction of an Arrow B toward the periphery of the cover and a spring 106 having its ends 108 anchored in the cover in openings 110 tends to force the valve poppet 102 in the direction of an Arrow C in FIG. 4, the poppet being coupled to a shank having a shoulder 112 which is engaged by an intermediate loop portion 114 of the spring as shown best in FIG. 5 of the drawing. Thus the spring tends to hold the poppet valve 102 closed in the direction of the Arrow C and a shoulder 116 on a shank 119 of the valve bears against a soft gasket 118 engaging with an inner side wall of the cover which has an opening 120 there through in which an actuator portion 122 of the valve shank 118 is reciprocally mounted.

Force applied by the finger of a person on the actuator portion 122 moves the shank 118 and poppet valve 102 in a direction opposite to the Arrow C. To open the valve relative to the seat 104 and to allow liquid to flow into the recess 100 and to be drinkable at the peripheral rim 96 of the cover 90. It will be seen that the poppet valve 102 may be forced against pressue of the spring 106 by excessive steam pressure inside the receptacle to automatically relieve the excessive steam pressure when the container is in an upright position and there by automatically preventing excessive pressure to be in existence when the valve 102 is opened by the actuator 122 and when the peripheral rim 96 is adjacent to persons lips near the recessed 100 through which hot coffee may flow around the poppet valve 102.

It will be obvious that various modifications may be resorted to without departing from the spirit of the invention.

I claim:

1. A drinking receptacle provided with a generally cup like body having a normally upper open end; a cover for said body removably and sealingly secured to said upper open end of said cup like body; said cover having a peripheral rim and a top plate portion surrounded by said rim; said top plate portion having upper and lower sides; said top plate portion having an outlet opening extending therethrough; said outlet opening being at a first location near the proximity of said rim; an openable valve disposed and adapted to close and open said drinking outlet opening; a finger engagable valve actuator movably mounted on said cover and being disposed at a second location near the proximity of said rim; said valve actuator having a shank integral with and fixed to said valve; said second location being disposed relative to said first location whereby said receptacle may be tilted to a disposition wherein said outlet opening is in a downward position and said valve actuator is in a relative upward position; said shank is provided with a poppet valve portion adjacent said actuator portion; said poppet valve portion adapted to seat against said side of said cover and in said opening therein around said shank; said poppet valve spaced from said openable valve so as to permit both valves to close concurrently in response to resilient action of said spring as it closes said openable valve in said outlet opening.

2. The invention as defined in claim 1, wherein: a gasket surrounds said shank adjacent said poppet valve portion and is disposed between said poppet valve portion and the inside of said cover whereby said gasket effectively seals between said poppet valve portion and the opening through which said shank extends in said cover so as to effectively compensate for any tolerance discrepancy between the positions of said openable valve and said poppet valve portion as they correspond with the respective valve seating areas in said cover.

3. A drinking receptacle provided with a generally cup like body having a normally upper open end; a cover for said body removably and sealingly secured to said upper open end of said cup like body; said cover having a peripheral rim and a top plate portion surrounded by said rim; said top plate portion having upper and lower sides; said top plate portion having a drinking opening extending therethrough; said drinking opening being at a first location near to the proximity of said rim; and openable valve disposed and adapted to close and open said drinking opening; a finger engagable valve actuator movably mounted on said cover and being disposed at a second location near the proximity of said rim; said valve actuator being integral with said valve; said second location disposed relative to said first location whereby said receptacle may be tilted to a disposition wherein said drinking opening is in a downward position and said valve actuator is in a relatively upward position; a cam portion extends downwardly from the lower side of said top plate portion; said shank of said valve having a cam portion projecting upwardly and engaging with said cam on said lower side of said top plate portion; both of said cams being inclined relative to each other such that the reciprocal motion of said valve actuator in an inward direction forces said shank away from said lower side of said top plate portion to thereby cause downward opening movement of said openable valve which openably closes said outlet opening.

4. A drinking receptacle provided with a generally cup like body having a normally upper open end; a cover for said body removably and sealingly secured to said upper open end of said cup like body; said cover having a peripheral rim and a top plate portion surrounded by said rim; said top plate portion having upper and lower sides; said top plate portion having an outlet opening extending therethrough; said outlet opening being at a first location near the proximity of said rim; an openable valve disposed and adapted to close and open said drinking outlet opening; a finger engagable valve actuator movably mounted on said cover and being disposed at a second location near the proximity of said rim; said valve actuator integral with and fixed to said valve; said second location being disposed relative to said first location whereby said receptacle may be tilted to a disposition wherein said outlet opening is in a downward position and said valve actuator is in a relative upward position; said openable valve being provided with a shank portion, said finger engagable valve actuator and said openable valve are integral with said shank portion which extends therebetween; said shank portion having a pair of spaced apart notches; a spring secured to said top plate portion and engaging one of said notches tending to hold said valve member in closed position wherein said openable valve portion is seated in said outlet opening; said spring adapted to be placed in the other of said notched portions during washing of said receptacle such that said openable valve is held in open position by said spring during washing operations relative thereto.

5. The invention as defined in claim 4 wherein: said spring is a U-shaped spring having opposite ends fixed to said top plate portion of said cover and said spring having an intermediate portion extending laterally through one of said notches in said shank portion.

* * * * *